United States Patent [19]

Arnaud et al.

[11] Patent Number: 4,901,946

[45] Date of Patent: Feb. 20, 1990

[54] SYSTEM FOR CARRIER GUIDANCE BY LASER BEAM AND PYROTECHNIC THRUSTERS

[75] Inventors: Philippe Arnaud, Orleans La Source; Marc Bernard, Marcilly en Villette, both of France

[73] Assignee: Thomson-Brandt Armements, Boulogne Billancourt, France

[21] Appl. No.: 307,341

[22] Filed: Feb. 6, 1989

[30] Foreign Application Priority Data

Feb. 12, 1988 [FR] France ..... 88 01684

[51] Int. Cl.[4] ..... F41G 7/24

[52] U.S. Cl. ..... 244/3.13

[58] Field of Search ..... 244/3.13, 3.22

[56] References Cited

U.S. PATENT DOCUMENTS

| | | | |
|---|---|---|---|
| 3,028,807 | 4/1962 | Burton et al. | 244/3.13 |
| 3,860,199 | 1/1975 | Dunne | 244/3.13 |
| 4,174,818 | 11/1979 | Glenn | 244/3.13 |
| 4,300,736 | 11/1981 | Miles | 244/3.13 |
| 4,347,996 | 9/1982 | Grosso | 244/3.22 |
| 4,709,875 | 12/1987 | Cremosnik et al. | 244/3.13 |
| 4,728,057 | 3/1988 | Dunne | 244/3.11 |

FOREIGN PATENT DOCUMENTS

| | | |
|---|---|---|
| 2469345 | 5/1981 | France . |
| 2567197 | 1/1986 | France . |
| 57-192129 | 5/1984 | Japan . |
| WO87/03359 | 6/1987 | PCT Int'l Appl. . |

*Primary Examiner*—Charles T. Jordan

*Attorney, Agent, or Firm*—Roland Plottel

[57] ABSTRACT

A system is provided for guidance, by laser beam and pyrotechnic thrusters, of one or a number of carriers such as missiles which are intended to intercept maneuvering targets such as aircraft, helicopters or tanks. Guidance of the carrier is performed partly from the ground by means of a laser beam (beam-rider guidance) which tracks the target and partly by means of pyrotechnic thrusters placed on board the carrier. At each instant, the carrier thus "knows" its position with respect to the ideal flight path provided by the laser beam. The carrier corrects its flight path by triggering a pyrotechnic thruster when its distance with respect to the ideal flight path is greater than a predefined threshold value and when its radial velocity to the ideal path is lower than a predefined threshold.

14 Claims, 2 Drawing Sheets

FIG. 1
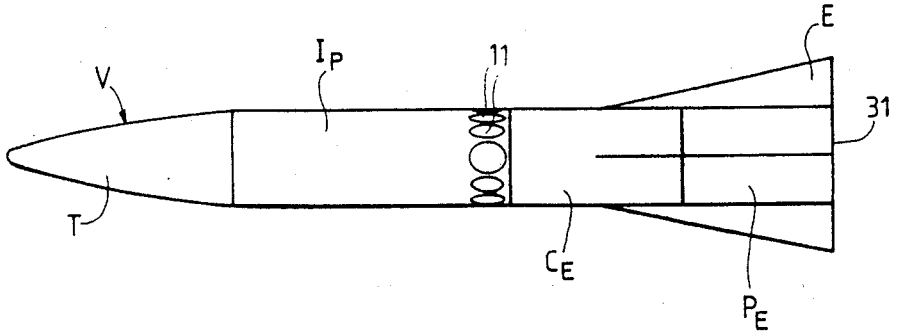
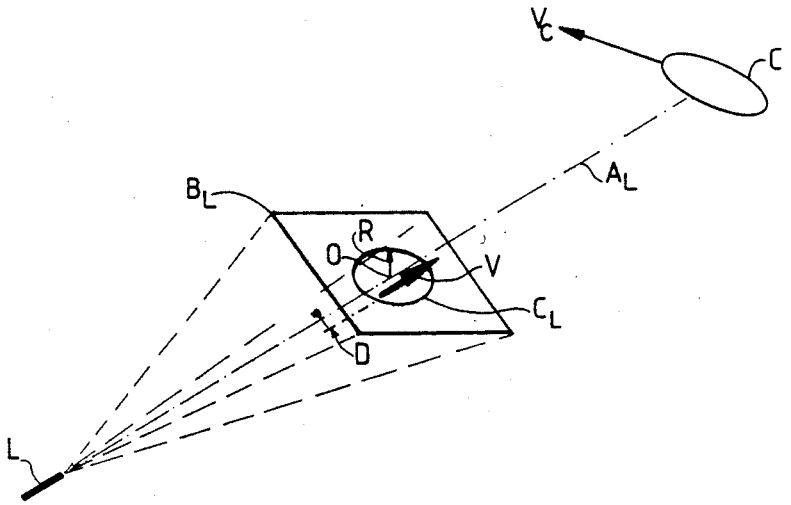
FIG. 2

FIG.3
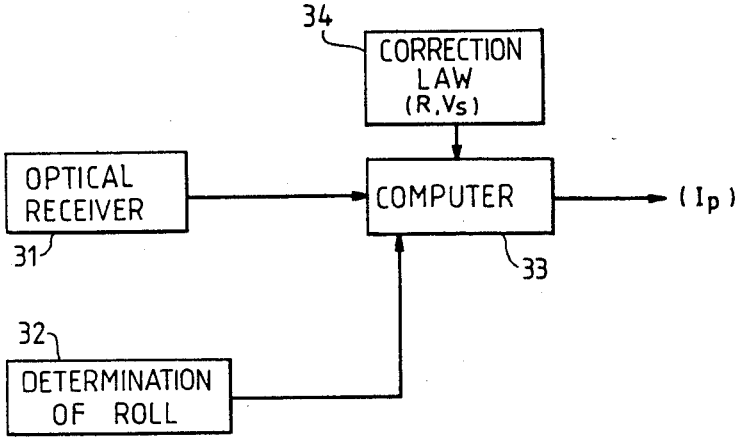
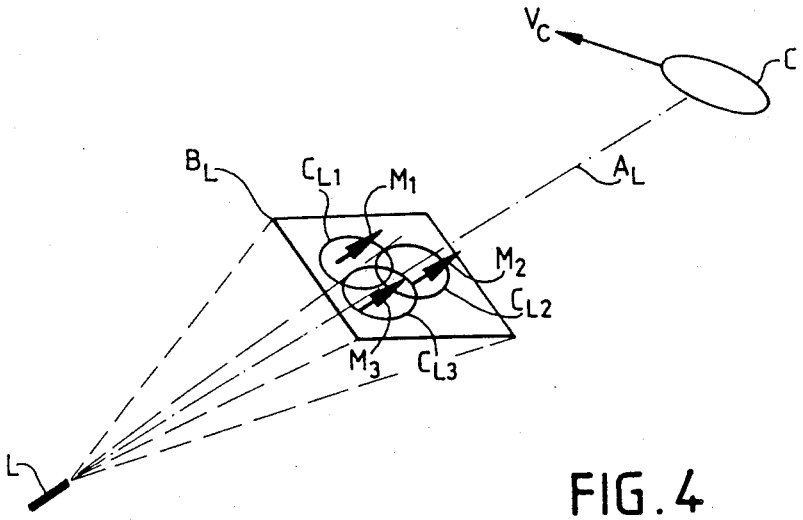
FIG.4

SYSTEM FOR CARRIER GUIDANCE BY LASER BEAM AND PYROTECHNIC THRUSTERS

BACKGROUND OF THE INVENTION

1. Field of the Invention

This invention relates to a system for guidance by laser beam and pyrotechnic thrusters, of one or a number of carriers which are intended to intercept maneuvering targets such as aircraft, helicopters or tanks. The invention also relates to a carrier adapted to guidance by a system of this type. The term carrier used in this context is understood to mean a guided missile which may or may not be self-propelled.

2. Description of the Prior Art

Different systems are known in which guidance is performed either entirely within the carrier by means of a homing system or partly on the ground by means of a remote control system or a laser beam.

When it is desired to construct an inexpensive carrier, the use of a homing system is excluded.

Accordingly, when part of the guidance is performed on the ground, the guiding means located within the carrier are usually of the aerodynamic type in order to achieve continuous follow-up control in dependence on the ideal flight path supplied by the ground.

However, the on board device necessary for aerodynamic guidance are fairly complex and, in addition, are not well suited to certain applications, especially those in which the accelerations sustained are large and those in which the carrier has small dimensions.

SUMMARY OF THE INVENTION

The present invention relates to a carrier guidance system which employs a beam of radiant energy such as a laser beam for tracking the target from the firing station located on the ground, for example, and pyrotechnic thrusters placed on board the carrier, the position of the carrier with respect to the ideal flight path supplied by the laser beam being thus "known" by the carrier at each instant. The carrier corrects its flight path by triggering a pyrotechnic thruster when its distance with respect to the ideal flight path becomes greater than a predefined threshold value and when the carrier radial velocity of approach to the ideal path is below a predefined threshold value.

In more precise terms, an object of the invention is a system for guidance of a carrier for hitting a target, comprising a firing station provided with means for launching the carrier and means for tracking the target and guiding the carrier by means of a beam of radiant energy which provides the carrier wtih an indication of its ideal flight path, comprising:

pyrotechnic thrusters each capable of producing a thrust for modifying the flight path of the carrier;

means for detection of radiant energy;

means for utilizing the aforesaid detection in order to determine the position of the carrier with respect to the ideal flight path supplied by the beam;

means for producing ignition of a predetermined pyrotechnic thruster when the distance from the carrier to the ideal flight path is greater than a predefined distance threshold and when the carrier radial velocity of approach to the ideal path is below a predefined threshold value.

BRIEF DESCRIPTION OF THE DRAWINGS

FIG. 1 is a diagram of a carrier in accordance with the invention.

FIG. 2 is an explanatory diagram of the system in accordance with the invention as applied to the guidance of a carrier.

FIG. 3 is a block diagram of the guidance means mounted on board the carrier.

FIG. 4 is a diagram of the guidance system in accordance with the invention as applied to a plurality of carriers.

In these differnet figures, the same references designate the same elements.

DESCRIPTION OF THE PREFERRED EMBODIMENTS

FIG. 1 is therefore a schematic representation of one embodiment of the carrier in accordance with the invention.

The carrier is designated by the general reference V and is made up of four portions considered successively from front to rear as follows:

a front portion T forming a bullet-nosed cone of streamlined shape;

a portion $I_p$ in which are placed pyrotechnic thrusters as shown by their orifices 11, together with their ignition devices and control leads. The orifices 11 are placed in a straight section of the carrier so as to exert on this latter thrust forces which are capable fo modifying its flight path. Said orifices are preferably susbstantially radial and (preferably also) pass substantially through the center of gravity of the carrier. A barrel system of thrusters of this type is described, for example, in French Patent Application No. 2,469,345 in the name of Thomson-Brandt;

a portion $C_E$ containing the explosive charge of the carrier;

a rear portion $P_E$ which mainly comprises electronic means for carrier guidance in cooperation with the information received from the ground, commonly designated as the "pilot", and an optical receiver 31 which is placed on the base of the carrier and detects the illumination of this latter by the guidance laser beam.

Finally, in order to ensure its aerodynamic stability, the carrier is provided with a tail fin system E.

In an alternative embodiment (not shown in the drawings), the carrier has motor means for its self-propulsion in at least a first acceleration stage of its flight path. By way of example, these motor means are constituted as described in French Patent application No. 2,567,197 in the name of Brandt-Armements. They are accordingly attached to the rear end of the carrier V and may be jettisoned if necessary at the end of the first step.

FIG. 2 illustrates schematically the system in accordance with the invention as applied to guidance of a carrier.

By way of example, the carrier is launched by a firing station located on the ground, comprising launching means (not shown) and a tracking turret adapted to carry a laser L. As mentioned earlier, the carier can be launched by gun-barrel effect and/or self-propelled in a first step of its flight path. It is preferably in autorotation about its longitudinal axis or spinned, this autorotation being imparted to the carrier either by the gun barrel or by the angle of setting, with respect to the longitudinal axis, of the fins which form the tail fin system E.

As shown in this diagram, the beam emitted by the laser L scans a fraction of space, the cross-section of which in a plane normal to the emission is designated in the figure by the reference $B_L$. This cross-section $B_L$ will be referenced-to hereinafter as the "laser plane". By way of example, scanning takes place along parallel lines which describe a square having a center O, the point O being located on an axis $A_L$ which continuously joins the laser L to a target C having a velocity $V_C$. In this figure, the carrier is also shown in the form of an arrow V located at a given instant, for example, at a distance D from the axis $A_L$.

In accordance with established practice, this type of laser beam guidance, also known as "beam riding", takes place as follows: the laser beam scans a portion of space whose axis ($A_L$) is dependent on the target C and represents the ideal flight path of the carrier. This scan takes place in such a manner as to ensure that, when the carrier is illuminated by the laser beam, its position can be deduced with respect to the axis $A_L$ in the plane $B_L$.

In accordance with the invention, the carrier pilot initiates a flight path correction only when the distnace D between the carrier and the axis $A_L$ is greater than a predefined threshold value R which defines at a given instant a circle $C_L$ having a center O about the axis $A_L$. In fact, the use of pyrotechnic thrusters, which consume their charge entirely once they have been ignited, results in a non-continuous and precalibrated correction. The initiation of a correction as soon as the distance D is no longer zero would result in a zigzag flight path of the carrier followed by loss of the carrier once all the thrusters have been employed. In accordance with the invention, the correction is therefore initiated only when the carrier is located at least at a distance R from the axis $A_L$ and the charge of the thrusters is calibrated so as to maintain the carrier within a circle having a radius R in the plane $B_L$.

Further, still in accordance with the invention and since the correction to be made is not independent of the radial velocity $V_R$ of approach of the carrier towards the axis $A_L$, a supplementary condition for initiation of a flight path correction is imposed: the correction is initiated only if the velocity $V_R$ is below a predetermined threshold value $V_s$.

In an alternative embodiment, the thrusters may not all develop the same thrust, in which case they are chosen by the carrier pilot both as a function of their position and of their thrust, as a function of the position of the carrier and of its velocity $V_R$.

In more general terms, it is possible by spinning the carrier to make a flight path correction in the desired direction while disregarding the position in the carrier of the thrusters which have not yet been employed.

It is worthy of note that the threshold distance R from which a flight path correction can be initiated may be variable in the case of a given carrier as a function of the distance of the target and/or of its area.

It is also worthy of note that, in accordance with a process known as the zoom effect, scanning of the plane $B_L$by the laser beam can be performed in a manner which is variable with the carrier-ground distance, with the result that the on-board electronic system does not have to make any correction in the determination of the value D as a function of said carrier-ground distance.

FIG. 3 is a block diagram of one embodiment of the electronic guidance means which are mounted on board the carrier.

In FIG. 3, there is shown the optical receiver 31 which delivers to a computer 33 an indication of illumination or of non-illumination of the carrier by the laser beam. By means of this indication, the computer determines the position of the carrier with respect to the axis $A_L$, the law of scanning of the plane $B_L$ by the laser beam being known. The computer 33 also receives if necessary a measurement of the position of roll of the carrier as supplied by a device 32 such as a gyroscope. Finally, the computer receives the data which constitute the flight-path correction law, namely the radius R, the velocity $V_s$, etc.., and which are recorded in memory 34, for example.

On the basis of these data, the computer 33 determines the radial velocity $V_r$ of the carrier, compares its distance D to the axis $A_L$ with the threshold value R, the velocity $V_r$ with the threshold value $V_s$ and, as a function of the roll position of the carrier, deduces or does not deduce therefrom an order for ignition of a predefined pyrotechnic thruster.

FIG. 4 illustrates an embodiment of the system in accordance with the invention as applied to guidance of a plurality of carriers at the same time.

In this figure, there is again shown the laser L, the scanning axis of which is made dependent on the target C. There is also shown the plane $B_L$ and, in this case, three carriers designated respectively by the reference $M_1$, $M_2$and $M_3$, in the plane $B_L$.

In accordance with the invention, each carrier performs a flight-path correction independently of the others, only when the distance and velocity criteria are fullfiled as in the case of a single carrier described with reference to FIG. 2. A circle is therefore shown in the plane $B_L$ around each carrier. These different circles, as designated respectively by the reference $C_{L1}$, $C_{L2}$ and $C_{L3}$, may or may not have the same radius.

In the figure, each of the circles $C_{L1} \ldots C_{L3}$ includes the axis $A_L$, with the result that there exist zones of intersection. It is considered, however, that the probability of having two or more carriers located in a single zone of intersection is sufficiently small to be negligible.

In an alternative embodiment, the circles $C_L$ may of course be so arranged as to avoid any intersection.

A carrier guidance system as thus described is simple and inexpensive, especially with regard to the on-board equipment, while offering high probability of impact on a receding target. Furthermore, a device for guidance by means of pyrotechnic thrusters lends itself readily of miniaturization, thus making it possible to reduce the bulk of the carrier and consequently to provide weapons systems which are capable of firing a plurality of carriers at the same time.

It will be understood that the foregoing description has been given solely by way of non-limitative example. From this it follows in particular that, although the carrier has been described as launched and guided by a laser beam emitted from the ground, it may also be launched and guided from a firing station mounted on board an aircraft, for example. Similarly, although the system for guiding from the ground has been described as seeking direct alignment with the real target at each instant, a variant may be contemplated in which said system may seek alignment with the future position of the target as calculated (on the ground) from its carrier velocity, at least at the beginning of guidance. In addition, the beam for ensuring guidance has been described as a laser beam but this latter can be replaced by any radiant energy beam sufficiently narrow to perform the function described, such as a microwave energy pencil beam having a frequency within the range employed for radars. Further, the laser beam has been described as directly tracking the target but, in a similar way, it can track the ideal flight path (computed on ground) in the case where the target cannot be seen e.g. for ground to ground system.

What is claimed is:

1. A system for guidance of a carrier for hitting a target, comprising a firing station provided with means for launching said carrier and means for tracking said target and guiding said carrier by means of a beam of radiant energy which provides said carrier with an indication of its ideal flight path, said carrier comprising:

pyrotechnic thrusters, each of said thrusters being capable of producing a thrust for modifying the flight path of said carrier;

means for detection of said beam;

means utilizing said detection for determining the position of the carrier with respect to said ideal flight path and the carrier radial velocity of approach to said ideal path;

means for producing ignition of one of said thrusters when the distance from said carrier to said ideal flight path is greater than a predefined distance threshold and said radial velocity is below a predefined velocity threshold value.

2. A system according to claim 1, wherein the tracking and guidance means of the firing station emit said beam and make the beam to scan a portion of space in accordance with a predefined law, the axis of said portion of space being dependent on the position of the target.

3. A system according to claim 2, wherein said position of the target is the future position of the target.

4. A system according to claim 1, wherein said beam of radiant energy is a laser beam.

5. A system according to claim 1, wherein the thrust produced by each pryotechnic thruster passes substanailly through the center of gravity of said carrier.

6. A system according to claim 1, wherein the thrust produced by each pyrotechnic thruster is oriented substantially radially with respect to said carrier.

7. A system according to claim 1, wherein said means for launching the carrier puts said carrier in autorotation about its longitudinal axis.

8. A system according to claim 1, wherein said launching means are capable of launching a plurality of carriers at the same time.

9. A system according to claim 1, wherein said threshold value of distance varies as a function of the carrier-target distance.

10. A system according to claim 1, wherein said threshold value of distance varies as a function of the area of the target.

11. A carrier for use with the system according to claim 1, comprising:

pyrotechnic thrusters, each of said thrusters being capable of producing a thrust for modifying the flight path of said carrier;

means for detection of said beam;

means utilizing said detection for determining the position of the carrier with respect to said ideal flight path and the carrier radial velocity of approach to said ideal path;

means for producing ignition of one of said thrusters when the distance from said carrier to said ideal flight path is greater than a predefined distance threshold and said radial velocity is below a predefined velocity threshold value.

12. A carrier according to claim 11, further comprising a tail fin system, the fins of which are set with respect to the longitudinal axis of the carrier in such a manner as to ensure autorotation of said carrier.

13. A carrier according to claim 11, further comprising means for determining its position of roll and delivering this latter to said means for producing ignition of a thruster.

14. A carrier according to claim 11, further comprising self-propulsion means.

* * * * *